US006135451A

United States Patent [19]

Kholodov

[11] Patent Number: 6,135,451

[45] Date of Patent: Oct. 24, 2000

[54] COMPUTER PROGRAMMING BOARD GAME AND METHOD OF PLAY

[76] Inventor: Igor Kholodov, 50 Webster St., Apt 406, Weymouth, Mass. 02190

[21] Appl. No.: 09/049,392

[22] Filed: Mar. 27, 1998

[51] Int. Cl.[7] ..... A63F 3/00

[52] U.S. Cl. ..... 273/236; 273/242

[58] Field of Search ..... 273/236, 242, 273/244.2, 248, 258, 261, 275, 287, 256

[56] References Cited

U.S. PATENT DOCUMENTS

| | | | |
|---|---|---|---|
| D. 249,697 | 9/1978 | Hester et al. | D19/59 |
| D. 318,069 | 7/1991 | Cheung et al. | D19/60 |
| 4,053,155 | 10/1977 | Williams | 273/87 |
| 4,062,545 | 12/1977 | Witney | 273/134 |
| 4,258,922 | 3/1981 | Landry | 273/302 |
| 4,272,080 | 6/1981 | Breslin | 273/249 |
| 4,316,612 | 2/1982 | Harder | 273/272 |
| 4,346,897 | 8/1982 | Sisak | 273/271 |
| 4,712,184 | 12/1987 | Haugerud | 364/513 |
| 4,927,156 | 5/1990 | Breslow et al. | 273/256 |
| 5,078,403 | 1/1992 | Chernowski et al. | 273/236 |
| 5,102,339 | 4/1992 | Parriera | 434/191 |
| 5,108,112 | 4/1992 | Gould | 273/256 |
| 5,318,447 | 6/1994 | Mooney | 434/128 |
| 5,421,730 | 6/1995 | Lasker, III et al. | 434/118 |
| 5,833,238 | 11/1998 | Watanabe | 273/236 |

*Primary Examiner*—Sam Rimell
*Attorney, Agent, or Firm*—Wolf, Greenfield & Sacks, P.C.

[57] ABSTRACT

The present invention provides a game for teaching a computer language. The game includes a board having a plurality of pathways with computer programming language indicia associated with the pathways. The invention also provides a method for playing a game where a player evaluates computer programming language commands. The player moves along pathways which include a plurality of board locations having computer programming language indicia associated with the board locations. By playing the game, a player can learn various computer language commands and can visually comprehend branching and looping constructs found in computer programming.

30 Claims, 1 Drawing Sheet

COMPUTER PROGRAMMING BOARD GAME AND METHOD OF PLAY

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention relates to board games and methods of playing a game and, more particularly, to a board game and method of play that include the concepts of computer programming.

BACKGROUND OF THE INVENTION

Board games have been a popular source of entertainment for a number of years. A number of games and methods of play have been developed and used.

For example, U.S. Pat. No. 4,258,922 relates to a game where the players select, by random chance, a succession of binary digits which correspond to operations performed in the arithmetic logic unit of a digital computer. Operations are then carried out on the digit sequences accordingly. Through these digit sequences and subsequent operations, the player learns the basics of binary mathematics.

U.S. Pat. No. 5,421,730 relates to an interactive learning system involving, in particular, syntax-intensive subject matter. The system analyzes a player's entries for syntactical correctness, and generates feedback information.

U.S. Pat. No. 5,102,339 relates to a mathematical educational game having circuitous individual paths.

U.S. Pat. No. 5,318,447 relates to a multiplication game for teaching arithmetic. The game includes a game board having a travel route divided into segments, where at least some of the segments has an arithmetic problem. Solving the arithmetic problem correctly allows a player to advance along the travel route.

SUMMARY OF THE INVENTION

According to one embodiment of the presented invention, a method of playing a game is disclosed, the method requiring evaluation of at least a portion of a computer language command to complete a turn.

According to one embodiment of the present invention, a method for playing a game is disclosed. According to this embodiment, a board is provided that has a plurality of pathways and computer programming language indica associated with the pathways. The computer language indica corresponds to a computer programming language. The embodiment proceeds by moving a first player marker on the pathways, the movement corresponding to the computer programming language indicia. The indicia may include conditional statements that do not require evaluating a random factor in determining whether to follow the conditional statement. The method may also include blocking movement of one player's marker when another player's marker is positioned on the same board location. Points may be accumulated based on the computer programming language indicia. The computer language indicia may define a complete computer program, with a player moving a marker along the pathways in correspondence with executing the complete computer program defined by the indicia.

According to another embodiment of the present invention, a method for playing a game is disclosed in which a first player marker is moved along a plurality of board locations on a board. According to this embodiment, points are received based on the moving step and computer programming language indicia associated with the board locations. The computer programming language indicia may include value indicium that corresponds to a computer language command for determining a value, with the receiving step including evaluating the computer language command to determine the value. The evaluating step may include determination of a random factor, such as the number of steps in the move.

According to another embodiment of the present invention, a method of teaching a computer programming language is disclosed. According to this method, a board is provided that has a plurality of pathways. A player moves a marker on the pathways based on computer programming language commands associated with the pathways. According to this embodiment, points may be received in correspondence with computer programming commands.

According to another embodiment of the present invention, a board for a board game is disclosed. According to this embodiment, the board has a surface, a plurality of pathways on the surface that include a plurality of board locations, and computer programming language indicia associated with the pathways. The surface may be flat. Substantially all of the surface of the board may be covered with the pathways and computer programming language indicia.

Other advantages, novel features, and objects of the invention will become apparent from the following detailed description of the invention when considered in conjunction with the accompanying drawing.

BRIEF DESCRIPTION OF THE DRAWINGS

(FIG. 1 is subject to copyright protection).

DETAILED DESCRIPTION

Figure 1:
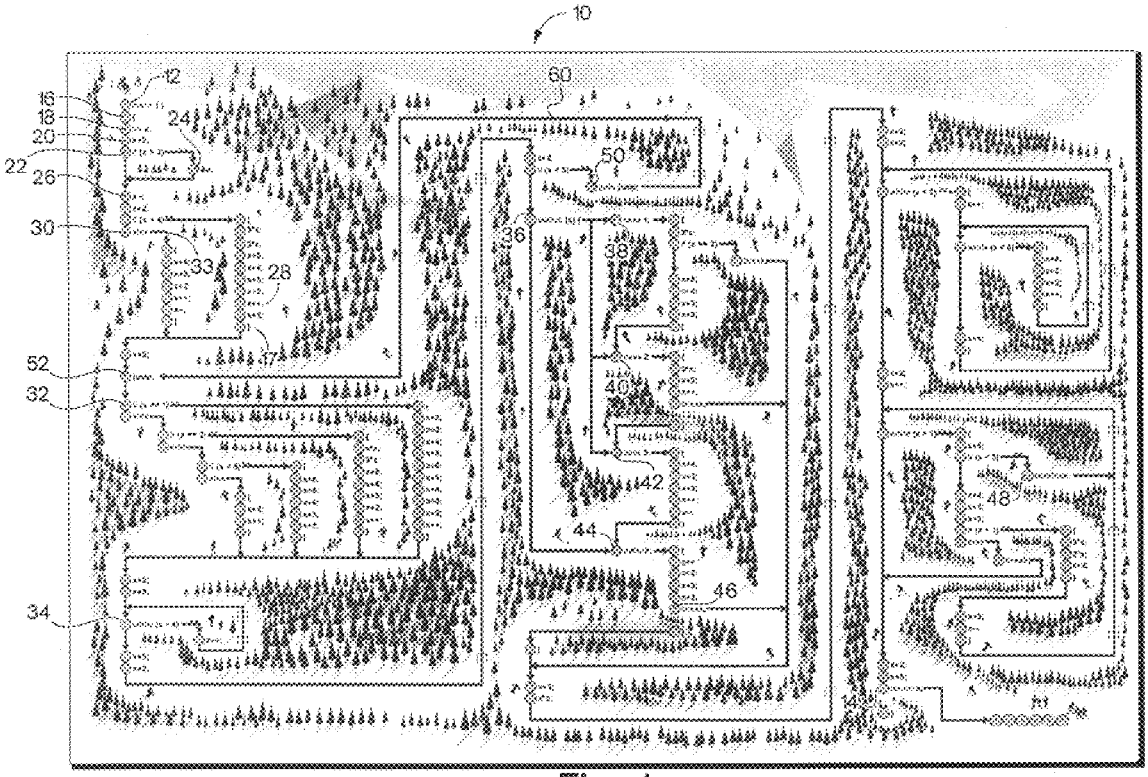
FIG. 1 represents a top view of one embodiment of a game board according to the present invention and that has a plurality of pathways, and indicia comprising C language commands

The elementary principles of computer programming are typically taught through an understanding of the various commands of a particular language. This presents an abstract view of computer languages to children and others not familiar with computer programming in general. The inexperienced programmer may lose sight of the overall goal of the program when simply presented with lists of the various commands which can represent a myriad of branches and loops. Moreover, learning computer programming according to conventional methods can be tedious and dull.

According to certain embodiments of the present invention, learning of computer programming concepts is made enjoyable by providing a board game and method of play designed to require use of computer programming concepts and principles. Thus, a person can learn computer programming concepts, and a computer language and computer language commands, via a board game. For example, by participating in certain embodiments of the game, the player can learn the various commands and can visually comprehend branching and looping constructs found in computer programming.

In addition, providing these elements in a board game affords a unique and novel new format for playing a game.

Accordingly, a board game according to the present invention can enhance enjoyment of play.

According to one embodiment described below, a board game is provided that includes a board having a layout that conforms to possible organizational constructs of a computer program. For example, by presenting the program as an array of pathways and commands located within the pathways, the player obtains a visual understanding of the program and immediately views the results of complying with a computer command. Thus, a program loop may resemble a circular pathway (i.e., a closed path, whether appearing circular, rectangular or otherwise) on the board; conditional statements may be located at the intersection of branching pathways; and "GOTO" commands may take the player to a designated location on the board. Playing of the game will allow a person to gain familiarity with the commands and their results.

In the embodiment described below with respect to FIG. 1, the board is a flat physical construct. Of course, the board could be nonplanar. The board can also possess a number of shapes, such as the rectangular shape shown in FIG. 1, circular shapes, oval shapes, etc. The term "board" as used herein includes not only a firm, flat board (whether foldable along one or more axes or otherwise and no matter what shape), but also a board made of another material (e.g., paper, cloth or plastic) or an electronically or computer implemented board.

In certain embodiments of the present invention, the board includes indicia defining a plurality of pathways. At least one player travels along a plurality of pathways by using at least one marker positioned on the board. A pathway is a section of board over which the player's marker may traverse during the game. Pathways may overlap.

The pathways may be made up of, or include, specific board locations—the marker being positioned on, and moved over, the board locations in the pathways (pathways may also include other indica, such as arrows). A board location is an area of the board where a player may begin or end a turn during play of the game, or a specified area of the board where the player takes a particular action during play (whether or not stopping on that location). Visually, the pathways may appear as any number of pathways (straight or otherwise) of board locations, including any number of loops and branches. Indicia at the board locations can identify the action taken at the pathway. Some or all of the such indicia may be formatted to correspond to a computer program or commands in a computer language.

Thus, for a player's turn, the player may traverse a pathway by moving the player's marker over the board locations within the pathway. The number of board locations traversed may be determined randomly, such as by rolling dice, spinning a pinwheel, automatically generating the number on a computer, or some other mechanism.

In many computer programming languages, the user presents the computer with a command (also known as a statement) and the computer carries out the corresponding function dictated by the command. In a certain embodiment of a board game of the present invention, players may be required to comply with a function corresponding to a computer command included on the board, as indicated by the indicia on the board. In the example described with reference to FIG. 1, the indicia associated with the board locations corresponds to commands in the C computer language. Of course, board games may be implemented that correspond to other computer languages, such as C++, JAVA, LISP, assembly level languages and others.

In the embodiment described with reference to FIG. 1, the object of the game is to accumulate points. In this case, some of the indicia corresponding to board locations may include arithmetic or other computer language statements that compute a value to be added to a player's running score (the player beginning with zero points and accumulating points as the game progresses). The arithmetic function may be based on a die roll for the turn, such as adding the die roll value, plus one, to the player's running score. Other arithmetic commands are possible, such as having a function that manipulates the player's current running score (e.g., doubling the player's current score, whatever that happens to be) or manipulates some other random or pseudo-random (e.g., the number of players playing) number.

Other end objects for playing the game are possible. As one example, the purpose of the game might be to navigate the pathways to visit certain board locations (or just the first to reach an end point) according to the computer statements.

Whatever the end object of the embodiment, the board may include some board locations having other types of computer language commands. For example, conditional branches and GOTO board locations may be included.

As described above, some embodiments of the game may be played by at least one player who travels along the plurality of pathways by using a marker positioned on the board. Where more than one player is participating in the game, the players may alternate turns in conventional fashion.

In one embodiment, each player operates more than one marker. In this case, the player taking a turn may select which of the player's markers to move. This selection process may be required to take place before, or alternatively after, the player determines how many board locations are traversed in that move (e.g., before or after the player rolls dice).

FIG. 1 illustrates one embodiment of a board 10 for a board game according to the present invention. The game board 10 is substantially planar and rectangular and possesses board locations (e.g. 12–16) and other indicia defining a plurality of pathways. In FIG. 1, the pathways are represented over a background of a mountain ski area for aesthetic purposes. Other designs (or no background design theme) may be used.

In this embodiment, board locations are identified by circles (e.g., 12–22). Pathways are identified by groupings of circles (e.g., circles 12–22 forming a straight segment of a pathway) and lines (e.g. line 60). Arrows are placed at the end of some of the lines to guide the player through the pathways (e.g., at line 60). In keeping with the theme of a mountain ski area in this embodiment, the markers to be positioned on board 10 are represented as skiers (not shown).

In this embodiment, the players start the game by placing the skiers (markers) on board location 12, which includes indicia "main ( )". This indicia corresponds to the C programming language, which has a function named "main" where the computer program begins—here the game provides "main ( )" as the starting point to illustrate this programming feature to the players. In this embodiment, no points are collected at this location. The game ends at board location 14, which has corresponding indicia illustrating the end of a C program.

During a player's turn, the player determines the length of the player's move (e.g., rolls a die). The method of play of this embodiment may be understood by explanation of the method of play at the various board locations in the embodiment of FIG. 1. In FIG. 1 and from the starting position 12, if the die roll value is one, the player moves one space to board location 16, marked "{" which is an opening brace in the C programming language. Other board locations may include indicium 17, a "}", which is a closing brace in the C programming language. Opening and closing braces are used to group statements together, resulting in a compound statement. Compound statements are similar to compound words, like "bookshelf", or "playground", when the two words are used as one. In this embodiment, no points are collected at either of these locations.

Again starting at board location 12, if the die roll value is two, the player places the skier (marker) at board location 18 as marked "int x;". The keyword "int" declares an integer variable in the computer programming language C. Such variables are often used to control loops and conditions in computer programs. In this embodiment, variable "x" represents the die roll value. Therefore, if a player's turn ends on a board location marked with indicia "int x;" the player collects a number of points equal to the die roll value.

Again starting at board location 12, if the die roll value is three, the player ends the turn on board location 20, which contains the arithmetic command "x+2;". The player replaces x with the die value and collects the number of points equal to the result of the arithmetic expression. In this example, if the die roll value was 3, then the player may collect 3+2=5 points. The same rule applies to any similar statement that contains an arithmetic command. For example, "x+4;" is defined as "add 4 to x", "6−x;" is defined as "subtract x from 6", "3*x;" is defined as "3 times x", "x+x;" is defined as "x plus x", and "x*x;" is defined as "x times x". Other embodiments might have fuller indica, such as "cs=cs+x+2;" where "cs" is the player's current score.

Again starting at board location 12, if the die roll value is four, the player places the skier at board location 22, which has corresponding indicia for a conditional command in the C programming language—"if (x>3)". (Other conditional statements, such as while and switch in the C programming language, are discussed below.) The "if" statement tests the condition inside the parentheses. Thus, this command tests "if x is greater than 3"—is the current die roll greater than three. When the condition is true, the player moves the skier to the first location past the "if" statement in the direction indicated by an arrow (here, on the right side of the "if" statement). In this example, the die roll value was four which is greater than three. The skier then advances to board location 24 and calculates a point value (of 6–4=2) to add to the player's running score. When the condition is false, the skier remains on the "if" statement location, and no points may be collected. When it is the player's turn to move this skier again, the player does not pass to, or over, board location 24, but continues along the other pathway (beginning with board location 26). (This example also illustrates use of two different pathways. Board locations 12, 16, 18 and 22 fall along the straight pathway whereas board location 24 is located on a branch pathway. This particular branch is simply a detour that unconditionally leads the player back to the straight pathway.)

The objective of the "if" statement and other conditional statements is to introduce to the player the concept of branching pathways and conditions and thus the rules described above are not intended to be limiting. In one embodiment, the conditional statement is based on the length of the move for the current player's turn, e.g., the roll of the die "x". Other values or functions may be used in place of, or in combination with, the length of the move. For example, a separate random or pseudo-random number could be used. Other embodiments of methods of play for the "if" statement (and other conditional statements) may allow a player landing (ending a turn on) on an "if" statement to evaluate the conditional statement on the next move instead (and determine a point value on that move) or evaluate the conditional statement during the present move, but determine a point value on the next move.

Again starting at board location 12, if the die roll value is five, the player places the skier (marker) at board location 26. (In this embodiment, as described above, a player that does not end a turn on the a conditional statement omits that step. Thus, there is no way to follow a branch of a conditional statement other than ending a turn on a board location corresponding to the conditional statement. Thus, in this case, the board location 22 is passed without determining whether the (x>3) condition is satisfied. In other embodiments, the conditional statement could be "executed" whenever the conditional statement is passed. In this example and for this alternative embodiment, the roll of five is greater than three and, therefore, the branch at board location 22 would be followed to board location 24 during the move.) Board location 26 contains the arithmetic command "x—;" which is the C programming language command for "subtract x by one". The player deducts one from the die roll value and adds this to the player's current score. If the die roll value is one, then the player accumulates 1−1=0 points. Board location 28 is marked by "x++;" which is the C programming command for "increment x by one". The player adds one to the die roll value. For example, if the die roll value is four, the player accumulates 4+1=5 points.

Board location 30 has corresponding indicia for an "else" command. In the C programming language, the "else" command allows the computer to execute statements when the condition of the "if" statement is false. In the board game of this embodiment, the skier (marker) passes to a corresponding "else" statement if the "if" condition is not met on the preceding turn (the preceding turn having ended in this embodiment on the "if" board location), or if the "if" statement is not tested because the player's turn was a roll sufficiently large to pass the "if" board location without ending the turn on that location. If a player's turn ends on a board location which has a corresponding "else" indicium (e.g., board location 30), the player collects zero points. During that player's next turn, the skier follows the direction of the arrow adjacent the "else" command (e.g., arrow 33).

Board location 32 has corresponding indicia for a conditional "if (x==1)" command which tests "if x is equal to 1". (The double equal sign, "==", is the C programming language notation for the "equal to" comparison.) In this example, the condition "(x==1)" is true only when the player's turn ends on board location 32 after a die roll of one. In all other cases the condition is false. As described above, for the "if" statement, the player may evaluate the condition during the next turn with a separate random or pseudo-random factor such as a separate die roll or the day of the week when the game is being played. In another embodiment (also as described above), any player passing over the conditional statement may use the die roll to evaluate the conditional statement and continue following the appropriate branching pathway depending on whether the condition is met.

Board location 34 has corresponding indicia with a "while (x<4)" command which is defined as "while x is less than 4"; again, this command corresponds to the "while" command in the C programming language. The "while" statement tests the condition inside the parentheses just like the "if" statement does. However, at the end of the branch created by the "while" statement there is an arrow pointing back to the "while" statement. This permits the "while" statement to be executed repeatedly in a loop, until the condition inside the parentheses becomes false. When the player's turn ends on the "while" statement and the condition is true, the player moves the skier to the first location past the "while" statement in the direction indicated by an arrow on the right side of the "while" statement. When the condition is false, the player's turn ends with the player's marker still located on the "while" statement location and no points are collected. During the player's next turn, the skier continues along the straight pathway and skips the "while" statement (unless landing on the "where" statement again). In this example, when x is five, the condition (x<4) is false. When x is equal to 1, 2, or 3 (for a turn ending on board location 34), the condition is true, and the skier enters the loop. As for the "if" board locations, the player only tests the "while" condition for turns that end on a board location having the "while" statement indicia. In other embodiments, however, the "while" statement can be performed for turns passing a "while" board location as well as (or instead of) turns ending on such a board location.

Board locations 36, 38, 40, 42 and 44 have indicia corresponding to C programming language commands for a "switch" statement—"switch (x) {", "case 1:", "case 2:", "case 3:", and "default:", respectively. If a player's turn ends on board location 36 ("switch"), the "switch" statement transfers the skier to one of its labels during the present move or alternatively on the next move. By using a random factor for the test, e.g., of choice i.e. the die roll of the present move or a separate random factor, the skier (marker) advances to the appropriate "case" label, or (if no "case" test is satisfied) to a board location having a corresponding indicia of "default:". The label is chosen according to the die roll value. For example, when the die value is one, two or three, the skier moves to location "case 1:", "case 2:", or "case 3:" respectively (the case statements need not have been one, two and three, but could instead have been two, four, five, or any other numbers or tests). In this example, when the number rolled is four, five or six, the skier moves to the "default:" label. When the skier passes the "switch" statement in the middle of a move, the skier follows the direction of the "default:" label. No points may be collected at any of the "switch" statement labels.

Board location 46 contains a "break" statement which is used to exit from a loop or from a "switch" statement. No points may be collected at this location, but the player automatically transfers to the next location if the player's turn ends on this location (or, in the alternative, if the turn ends on the "break" location the player awaits the next turn to move on). The player also follows the "break" statement when passing the corresponding board location in the middle of a move. Board location 48 has corresponding indicia for a C programming "continue" statement, which forces the immediate transfer of the skier to the "while" statement. No points may be collected at this location. In another embodiment, if a die roll causes a player to pass over a "break" statement, a player may be forced to stay at the present location and await the next turn or concurrent turns to obtain a die roll that allows the player to land on the "break" statement (with or without collecting points when the player cannot move). In yet another embodiment, if a die roll causes a player to pass over a "break" statement the player may be forced to stop at the "break" location, until the next turn.

Board location 50 contains indicia for a C programming language "GOTO" jump statement, which performs an unconditional transfer of a skier (marker) to a programming label (or board location) "jump", here shown in board location 52. The "jump" label is a named location in a program. It allows the "GOTO" statement to use this label to transfer the skier to the "jump" location to produce a type of loop different than that generated by a "while" statement. Methods of play for the "GOTO" jump location may include keeping the skier (marker) on the "GOTO" location and waiting for the next turn to move to the "jump" location, or allowing the player to continue to the "jump" location during the present move. In this embodiment, no points are collected at either board locations for GOTO statement or jump labels, e.g., board locations 50 and 52.

Board location 14 is the end point of this embodiment and has corresponding indicia for the "return x;" C programming command. In a C computer program, the "return" statement ends main ( ) and returns the value of x. The "return" statement has an arrow pointing to six circles with numbers "1", "2", "3", "4", "5", and "6". These numbers do not correspond to a computer program, but exist in this embodiment for the purpose of allocating the final points that a player may collect when the skier passes the "return" statement. The player may add this number to the total score. Once past the "return" statement, the player may be considered to be out and becomes inactive.

The game ends when the last original skier reaches one of the numbers beyond the return statement. In other embodiments, the player is permitted to reenter the game after moving to one of these numbers, by returning to the main ( ) board location 12. Players may be permitted to reenter the game as many times as needed until the last original skier finishes the game. The player with the highest running score at the end wins. As described above, any number of other conditions can be used for determining a winner and determining when to end the game. As just one example, the game can end when a first player passes the return board location 14, with the highest score winning.

In certain embodiments of the present invention, a player may block another players' marker from moving by landing on a board location already occupied by the other player's marker. Those markers remain blocked until the last player to arrive at the board location moves from that location. If all of a player's markers are blocked, the player loses a turn.

In another embodiment, the invention provides a game to be played on a computer. The board with a plurality of pathways, computer programming language indicia associated with the pathways and the player markers can all be displayed on a computer screen. The computer provides a computer language command and the players evaluate the command by inputting an answer into the computer. The players can move their markers by inputting a moving command or the computer can automatically advance a player's marker according to the computer language command.

In another embodiment, the game may be displayed on the computer screen as an animated sequence. For example, if the player's markers are represented as skiers, the player would view a skier on the computer screen. After a player a player evaluates a computer language command, the skier may be viewed as skiing along a mountain instead of moving along a plurality of pathways. Of course, the markers may be represented by characters other than skiers. The game may also provide other multimedia effects such as sound, video clips, three-dimensional scenery and an electronic agent advising a player on how to evaluate a computer language command.

Another embodiment of the invention provides a method of editing the computer language command or part of a command. In this embodiment, teaching of the computer language may be an interactive process. Thus, the game includes a program text editor that allows interactive editing of the indicia—providing the possibility of compiling, executing, and interactive debugging of a program created in such an editor during or before play. With these embodiments, a player is not limited to a particular set or order of computer language indicia, pathways, scenery and/or player markers e.g., the player can change the board before (or, in the alternative) during play. In addition, a player could be permitted to change the difficulty level of the game by adding extra computer language commands which provide complex branching and looping constructs.

Those skilled in the art would readily appreciate that all parameters listed herein are meant to be exemplary. A number of variations on the method of play, the indicia used and the actions taken corresponding to the indicia would be apparent based on the disclosure provided herein and are intended to be within the scope of this invention. It is, therefore, to be understood that the foregoing embodiments are presented by way of example only and that, within the scope of the appended claims and equivalents thereto, the invention may be practiced otherwise than as specifically described.

What is claimed is:

1. A method for playing a game, comprising steps of:

performing a plurality of turns; wherein at least one of the turns comprises a step of having a player performing the turn evaluate at least a portion of a command, the command being formatted to correspond to a computer programming language command used for programming a computer.

2. The method of claim 1, further comprising a step of:

providing a board comprising a plurality of pathways and computer programming language indicia associated with the pathways, the computer programming language indicia corresponding to a computer programming language;

and wherein the having step comprises a step of moving a first player marker on the pathways, the movement corresponding to the computer programming language indicia associated with the pathways.

3. The method of claim 2, wherein the computer programming language indicia includes a conditional statement indicium corresponding to a conditional statement in the computer programming language;

and the moving step comprises steps of evaluating the conditional statement, and branching from one of the pathways to another of the pathways based on the evaluation of the conditional statement.

4. The method of claim 3, wherein the evaluating step includes a step of evaluating the conditional statement based on a random factor determined for the moving step.

5. The method of claim 2, wherein the pathways include a plurality of board locations; and the method further comprises a step of blocking movement of the first player marker when a second player marker is positioned onto the same board location.

6. The method of claim 2, wherein the computer programming language indicia includes a jump statement indicium corresponding to a branching statement in the computer programming language;

and the moving step comprises a step of moving from one of the pathways to another of the pathways based on the jump statement indicium.

7. The method of claim 2, wherein the having step further comprises a step of accumulating points based on the computer programming language indicia.

8. The method of claim 2, wherein:

the computer programming language indicia defines a complete computer program, including indicia corresponding to completing execution of the program; and the method further comprises a step of continuing to move the first player marker along the pathways until traversing computer programming language indicia corresponding to completing execution of the computer program.

9. The method of claim 1, wherein:

the at least one turn comprises a step of moving a first player marker for a first player along a plurality of board locations on a board; and the having step includes a step of receiving points based on the moving step and the computer programming language indicia associated with the board locations.

10. The method of claim 9, wherein:

the computer programming language indicia includes value indicium corresponding to a computer language command for determining a value; and the receiving step comprises a step of evaluating the computer language command for determining the value.

11. The method of claim 10, wherein the indicium corresponding to a computer language command for determining the value is a function of a random factor determined for the moving step.

12. The method of claim 11, wherein the random factor is a length of the move.

13. The method of claim 9, further comprising a step of providing a second player marker for the first player, and wherein:

the moving step comprises a step of selecting which of the first player marker and the second player marker to move.

14. The method of claim 9, wherein:

the board locations are within a plurality of pathways; and the moving step comprises a step of moving the first player marker on the pathways, the movement corresponding to the computer programming language indicia associated with the pathways.

15. The method of claim 9, wherein:

the computer programming language indicia defines a complete computer program, including indicia corresponding to completing execution of the program; and the method further comprises a step of continuing to move the first player marker along the pathways until traversing computer programming language indicia corresponding to completing execution of the computer program.

16. A method of teaching a computer programming language, comprising steps of:

providing a board having a plurality of pathways; and moving a player marker on the pathways based on computer programming language commands that correspond to computer programming language commands used for programming a computer, the commands being associated with the pathways and visible to a player.

17. The method of claim 16, further comprising a step of receiving points based on the moving step and the computer programming language commands associated with the pathways.

18. The method of claim 17, wherein the computer programming language commands includes a computer language command for determining a value and the receiving step comprises evaluating the computer language command for determining the value.

19. The method of claim 16, wherein the computer programming language commands include a conditional statement;

and the moving step comprises steps of evaluating the conditional statement, and branching from one of the pathways to another of the pathways based on the evaluation of the conditional statement.

20. The method of claim 16, wherein the moving step comprises a step of moving the player marker along the pathways in correspondence to execution of a complete computer program.

21. A board for a board game, the board comprising:

a surface;

a plurality of pathways on the surface, the pathways including a plurality of board locations; and computer programming language indicia associated with the pathways, the computer programming language indicia corresponding to a computer programming language command used for programming a computer.

22. The board of claim 21, wherein the surface is substantially flat.

23. The board of claim 21, wherein the board is displayed on a computer screen.

24. The board of claim 21, wherein the computer programming language indicia includes a conditional statement indicium corresponding to a conditional statement in the computer programming language.

25. The board of claim 24, wherein the conditional statement indicium is associated with one of the board locations; and the board further comprises directing indicia, corresponding to the conditional statement indicium, to direct movement of a player's marker from the board location associated with the conditional statement indicium.

26. The board of claim 21, wherein the computer programming language indicia includes:

a jump statement indicium; and directing indicium to indicate one of the board locations to which a player moves when following the jump statement indicium.

27. The board of claim 21, wherein the computer programming language indicia includes value indicium corresponding to a computer language command for determining a value.

28. The board of claim 27, wherein the value indicium includes a variable indicium to designate a random factor associated with a move a player makes.

29. The board of claim 21, wherein substantially all of the surface is covered with the pathways and the computer programming language indicia.

30. The board of claim 21, wherein the computer programming language indicia defines a complete computer program.

* * * * *